United States Patent [19]

Moinuddin

[11] 4,130,383

[45] Dec. 19, 1978

[54] APPARATUS FOR NOISE SUPPRESSION IN A GEAR PUMP

[75] Inventor: Mohammed Moinuddin, Wooster, Ohio

[73] Assignee: Borg-Warner Corporation, Chicago, Ill.

[21] Appl. No.: 809,229

[22] Filed: Jun. 23, 1977

[51] Int. Cl.[2] ..... F01C 19/08; F01C 21/00; F01C 1/18; F04C 1/04

[52] U.S. Cl. ..... 418/78; 418/131; 418/189

[58] Field of Search ..... 418/75, 131–135, 418/189, 190, 78

[56] References Cited

U.S. PATENT DOCUMENTS

| | | | |
|---|---|---|---|
| 2,424,751 | 7/1947 | Heckert | 418/75 |
| 2,915,976 | 12/1959 | Demtchenko | 418/131 |
| 3,303,792 | 2/1967 | Littlewood | 418/189 |

FOREIGN PATENT DOCUMENTS

| | | | |
|---|---|---|---|
| 598371 | 9/1925 | France | 418/189 |

*Primary Examiner*—John J. Vrablik
*Attorney, Agent, or Firm*—Julian Schachner

[57] ABSTRACT

A pressure plate provides a trapped pressure relief groove oriented along the line of action of mating gears in a gear pump. The groove communicates the fluid trapped between the gear teeth with both the inlet and outlet, thereby reducing high squeezed pressures and lowering hydraulic noise levels. Noise suppression is apparent at all speeds, and is particularly apparent at high pump operating speeds.

12 Claims, 6 Drawing Figures

APPARATUS FOR NOISE SUPPRESSION IN A GEAR PUMP

BACKGROUND OF THE INVENTION

This invention relates generally to a fluid pump. More particularly it relates to a gear pump having provisions for the relief of fluid trapped due to action of the gear teeth during normal pump operation.

During normal operation of a gear pump, the gear teeth move into meshing engagement, thereby creating cavities between the points of contact of adjacent pairs of meshing teeth. Engagement is along a line of action extending through the pitch point of the gears. Fluid is trapped in the cavities, and is subject to pressure changes as cavity volume changes.

At the point of initial tooth contact, the cavity is in fluid communication with the pump outlet. As this initial tooth contact approaches the minimum land position, the volume of the cavity is reduced and fluid communication with the outlet is interrupted. When the cavity volume is at a minimum, the squeezed pressure of fluid within the cavity is at a maximum. Thereafter, as the teeth continue to move during normal operation, cavity volume increases with a corresponding decrease in squeezed pressure. As the teeth approach the point where tooth contact is broken, fluid communication is established between the cavity and the pump inlet.

The prior art discloses various examples of pressure plates having inlet and outlet recesses designed to relieve squeezed pressures, either to the outlet or inlet, or in some cases to both. However, a common feature of the prior art is that direct communication with the recesses is interrupted as the teeth move through the minimum land position. Pumps heretofore have been designed to establish a fluid seal at some point for the purpose of reducing leakage and thereby minimizing any reduction in volumetric efficiency. A problem common to such prior art pumps is the high level of hydraulic noise. There remains a need in the art for a gear pump having apparatus for suppressing excessive hydraulic noise without at the same time causing an unacceptable reduction in volumetric efficiency.

SUMMARY OF THE INVENTION

A primary object of this invention is to provide an improved gear pump having apparatus which will meet the need noted above. The invention is directed to a gear pump having at least one pressure plate defining inlet and outlet recesses and a trapped pressure relief groove. This groove is oriented so as to communicate the recesses along the line of action of the mating gear teeth. At any given position of the gears, some of the fluid trapped in the cavity created between adjacent gear teeth is relieved. There is a maximum limit on the squeezed pressure, and no abrupt change in the pattern of fluid flow. Significant suppression of hydraulic noise is achieved.

BRIEF DESCRIPTION OF THE DRAWINGS

The objects and advantages of this invention will become apparent to those skilled in the art upon careful consideration of the specification herein, including the drawings, wherein.

Figure 1:
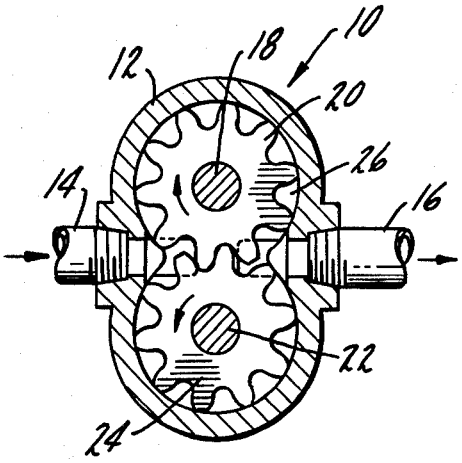
FIG. 1 is a diagrammatic view of a typical gear pump.
Figure 2:
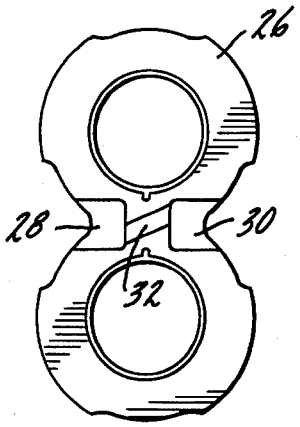
FIG. 2 is a slightly enlarged view of a pressure or wear plate common to typical gear pumps.
Figure 3:
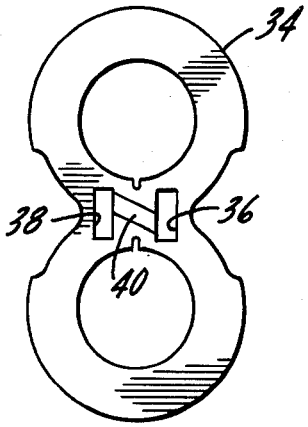
FIG. 3 is a slightly enlarged view of a pressure or thrust plate common to typical gear pumps.

While this invention is susceptible of embodiment in many different forms, there is shown in the drawings and herein will be described in detail a preferred embodiment, with the understanding that the present disclosure is to be considered as an exemplification of the principles of the invention and is not intended to limit the invention to this embodiment.

DESCRIPTION OF THE PREFERRED EMBODIMENT

Referring now to the drawings in greater detail, there is shown a typical gear pump 10 having a suitable housing 12. An inlet 14 and an outlet 16 are in fluid communication with the interior chamber of housing 12. A drive shaft 18 is supported for rotation within housing 12. A first, drive gear 20 is secured to shaft 18 for rotation therewith. Similarly, a driven shaft 22 is supported for rotation within housing 12. A second, driven gear 24 is secured to shaft 22 for rotation therewith. Gears 20 and 24 are in meshing engagement.

A pressure or wear plate 26 conforms generally to the interior configuration of housing 12 and is in abutting engagement with one side face of gears 20 and 24. Wear plate 26 is provided with an inlet recess 28 and an outlet recess 30 respectively in fluid communication with inlet 14 and outlet 16. In one preferred form of the invention, inlet recess 28 and outlet recess 30 are rectangular, although it should be understood that their particular shape may vary in accordance with the design considerations of a particular pump. Details with regard to a typical wear plate 26 are disclosed in U.S. Pat. No. 3,371,615 issued Mar. 5, 1968 to A. E. Pettyjohn et al.

Wear plate 26 is provided with a trapped pressure relief groove 32 extending along the line of action of gears 20 and 24 between inlet recess 28 and outlet recess 30 so as to provide limited fluid communication therebetween.

In one preferred form of the invention, there is provided a pressure or thrust plate 34 which may be formed from bronze or some other suitable material. Thrust plate 34 conforms generally to the interior configuration of housing 12 and is in abutting engagement with the other side face of gears 20 and 24. Thrust plate 34 defines holes 36 and 38 respectively in fluid communication with inlet 14 and outlet 16. Recesses 28 and 30 of wear plate 26 and holes 36 and 38 of thrust plate 34 serve essentially the same purpose. The particular configuration of the recesses or holes may vary, and is determined by the design characteristics of a particular pump.

A trapped pressure relief groove 40 along the line of action of gears 20 and 24 provides limited fluid communication between holes 36 and 38. Grooves 32 and 40 are similar, and are oriented so as to be parallel when pressure plates 26 and 34 are in abutting relationship with opposite side faces of gears 20 and 24.

Preferably the teeth of gears 20 and 24 are of conventional involute form having the same pitch diameter with the same number of teeth. However, it should be understood that the invention is applicable to other types of gears. As gears 20 and 24 rotate, respective teeth come into contact at points A and B. These points of contact define a line of action C. As gears 20 and 24 continue to rotate, the contact points move essentially along this line of action. Groove 32 of pressure plate 26 preferably is oriented so as to extend along line of action C. Groove 40 of pressure plate 34, on the other side of gears 20 and 24, is similarly oriented.

Figure 4:
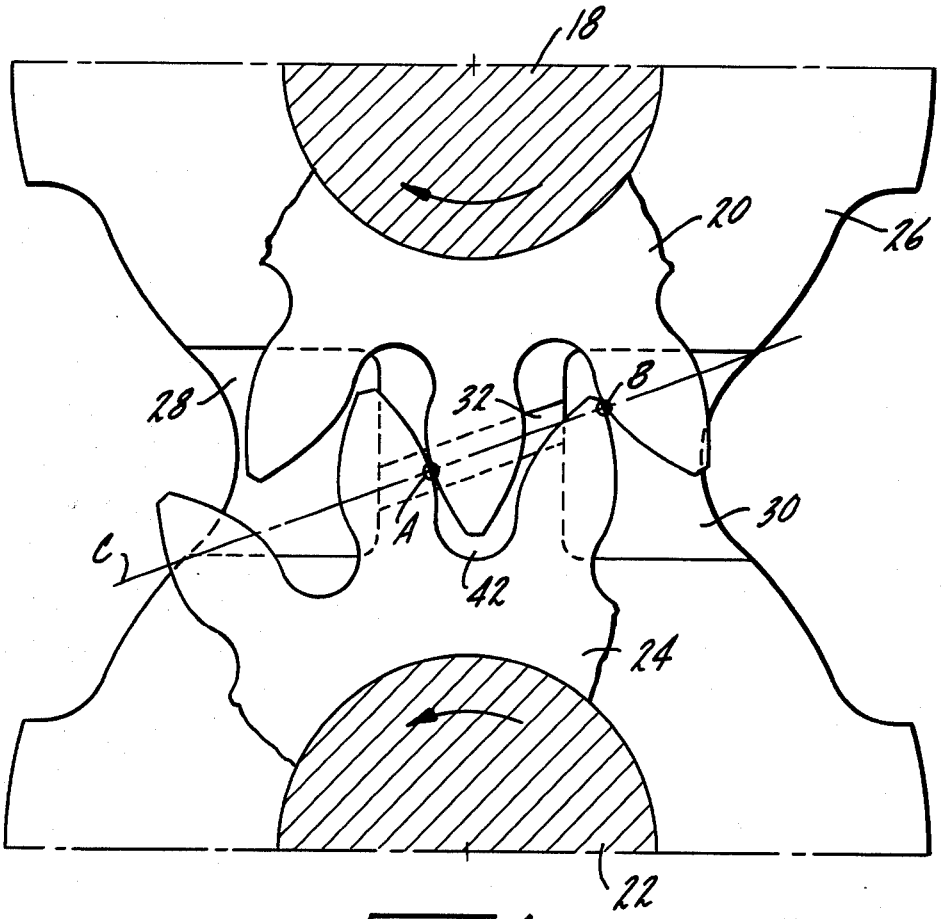
FIG. 4 is a greatly enlarged view showing details of the gear teeth at the point of initial tooth contact.

As shown in FIG. 4, adjacent teeth of gears 20 and 24 reach the point of initial contact B. A cavity 42 is defined between contact points A and B of adjacent pairs of meshing teeth. Cavity 42 is in fluid communication with outlet recess or hole 30–38, and some fluid within cavity 42 is relieved thereby. As gears 20 and 24 approach the minimum trapped volume position shown in FIG. 5, fluid communication between cavity 42 and outlet recess or hole 30–38 is interrupted. At this position, fluid communication between cavity 42 and inlet recess or hole 28–36 is not yet established. Thus, cavity 42 would be isolated but for trapped pressure relief grooves 32 and 40.

Grooves 32 and 40 respectively communicate cavity 42 with both recesses or holes 28–30 and 36–38. This establishes, in effect, a limited open-center condition wherein cavity 42 is never isolated. By providing limited relief for fluid trapped within cavity 42, an upper limit is established for the squeezed pressure, resulting in significant noise suppression.

Figure 5:
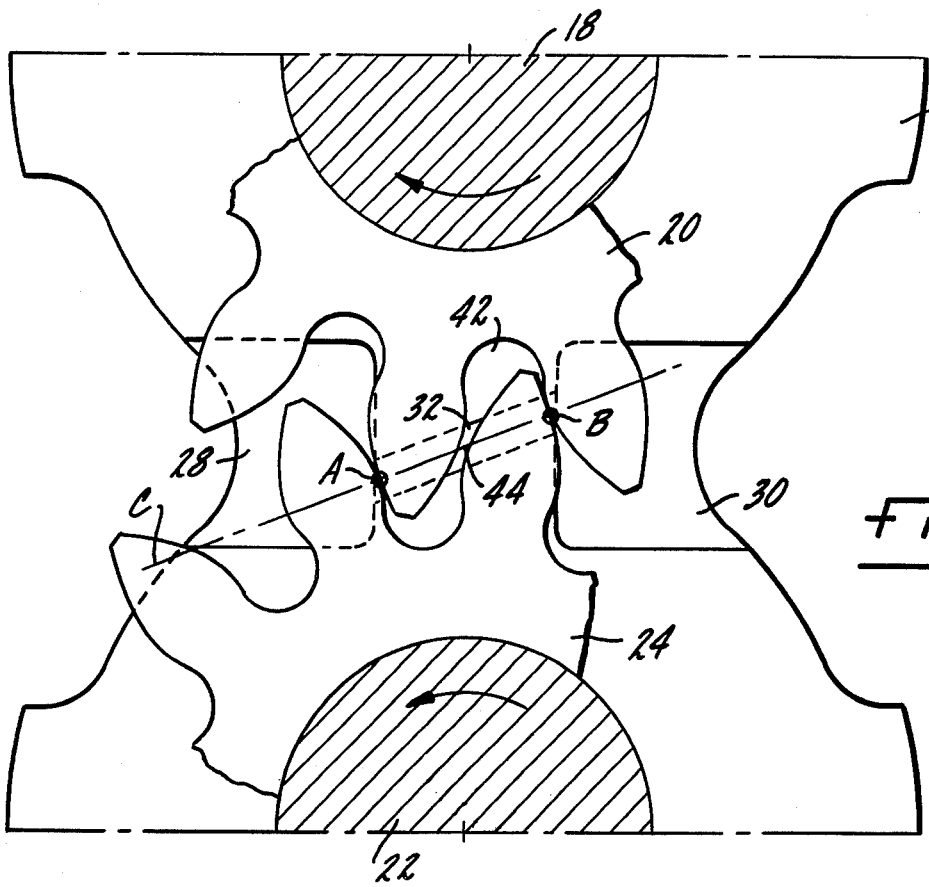
FIG. 5 is a view similar to FIG. 4 showing details of the gear teeth in the minimum trapped volume position at the land.

In the position shown in FIG. 5, cavity 42 defines a backlash area 44 between adjacent teeth of gears 20 and 24. Backlash area 44 creates, in effect, the throat of a venturi, and high fluid velocities therein also contribute to hydraulic noise. By orienting the grooves to communicate with this backlash area, it has been found that significant noise suppression is obtained at a cost of relatively little reduction in pump volumetric efficiency. It is advantageous in this regard to orient the grooves along line of action C.

Figure 6:
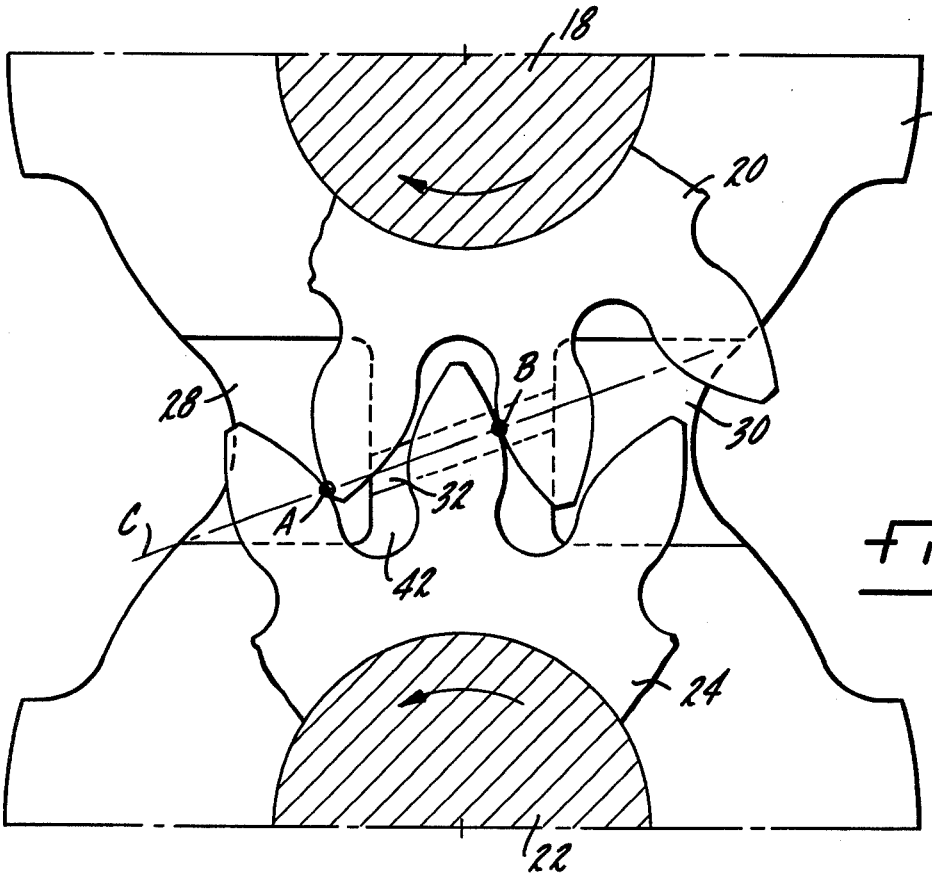
FIG. 6 is a view similar to FIG. 4 showing details of the gear teeth at the point of final tooth contact.

As gears 20 and 24 move from the position shown in FIG. 5 to the position shown in FIG. 6, fluid communication is established between cavity 42 and inlet recess or hole 28–36. Thus, at any given position of the gears, there is no seal for cavity 42, and some fluid always is relieved. This is a factor to be considered in determining the depth and width of grooves 32 and 40.

In the preferred form of the invention, both wear and thrust plates are provided. However, it should be understood that the invention herein may be used in pumps having only one pressure plate, or indeed in pumps having no pressure plate. In such instances, it may be desirable to provide one or more trapped pressure relief grooves in the side walls of housing 12.

Although the invention herein has been described with reference to a pump, it is equally applicable to a motor.

An important advantage of this invention is that it may be used with pumps already in the field simply by substituting pressure plates having trapped pressure relief grooves for existing pressure plates.

It is to be understood that while a preferred embodiment of the invention has been shown and described, this should be considered as illustrative and may be modified by those skilled in the art. It is intended that the claims herein cover all such modifications as may fall within the spirit and scope of the invention.

I claim:

1. A fluid pump comprising a housing defining a chamber, an inlet and an outlet communicating with said chamber, a pair of gears supported for rotation in said chamber, said gears having meshing gear teeth defining in one position thereof an area of maximum pressure, means defining inlet and outlet trapping recesses at one side face of said gears respectively communicating with said inlet and outlet, and a trapped pressure relief groove having a fixed flow area, said groove communicating said area of maximum pressure with both of said recesses.

2. The invention of claim 1, said gear teeth meshing along a line of action upon rotation of said gears, and said groove being oriented along said line of action.

3. The invention of claim 2, said means being a pressure plate in said chamber interposed between said housing and said one side face of said gears, said pressure plate also defining said groove.

4. The invention of claim 3, further comprising another pressure plate in said chamber interposed between said housing and the other side face of said gears, said other pressure plate defining other inlet and outlet trapping recesses at said other side face of said gears respectively communicating with said inlet and outlet, said other pressure plate also defining another trapped pressure relief groove having a fixed flow area, said other groove communicating said area of maximum pressure with both of said other recesses, said other groove being oriented along said line of action.

5. The invention of claim 4, said pressure plate being a wear plate, and said other pressure plate being a thrust plate.

6. In a pressure plate adapted for use in a gear pump including meshing gears defining in one position thereof a cavity of minimum volume, said pressure plate having spaced trapping recesses; the improvement wherein said pressure plate defines a trapped pressure relief groove having a fixed flow area, said groove being constructed and arranged so as to communicate the cavity with both of said recesses when the gears are in their one position.

7. The invention of claim 6, said groove being constructed and arranged so as to extend along the line of action of the gears.

8. The invention of claim 6, said recesses defining a minimum land therebetween, and said groove being in said minimum land.

9. The invention of claim 8, said groove being constructed and arranged so as to extend along the line of action of the gears.

10. A fluid pump comprising a housing defining a chamber, an inlet and an outlet communicating with said chamber, drive and driven gears supported for rotation in said chamber, said gears having teeth meshing along a line of action upon rotation of said gears, and at least one pressure plate in said chamber contiguous to a side face of said gears, said pressure plate defining a pair of trapping recesses facing said side face of said gears and respectively communicating with said inlet and outlet, said recesses being spaced to define therebetween a minimum land, said gears defining a cavity between the contact points of meshing teeth, said cavity having a minimum volume in one position as said gears rotate across said minimum land, said teeth having a backlash area therebetween in said one position, and said pressure plate further defining trapped pressure relief means having a fixed flow area and communicating said backlash area with both of said recesses.

11. The invention of claim 10, said trapped pressure relief means being a groove facing said side face of said gears and communicating said backlash area with both of said recesses.

12. The invention of claim 11, said groove communicating said backlash area with both of said recesses along said line of action.

* * * * *